US005088893A

United States Patent [19]

Gilbert et al.

[11] Patent Number: 5,088,893

[45] Date of Patent: Feb. 18, 1992

[54] MOLTEN METAL PUMP

[75] Inventors: Ronald E. Gilbert, Chardon; George S. Mordue, Ravenna, both of Ohio

[73] Assignee: The Carborundum Company, Niagara Falls, N.Y.

[21] Appl. No.: 649,221

[22] Filed: Jan. 25, 1991

Related U.S. Application Data

[63] Continuation of Ser. No. 315,619, Feb. 24, 1989, abandoned.

[51] Int. Cl.[5] ..... F04D 17/08

[52] U.S. Cl. ..... 415/200; 415/206; 415/214.1; 248/231.7

[58] Field of Search ..... 415/200, 203, 206, 214.1; 248/225.31, 230, 231.7, 316.1

[56] References Cited

U.S. PATENT DOCUMENTS

| | | | |
|---|---|---|---|
| 3,255,702 | 6/1966 | Gehrm | 415/200 |
| 3,776,660 | 12/1973 | Anderson et al. | 415/200 |
| 4,786,230 | 11/1988 | Thut | 415/182.1 |
| 4,940,384 | 7/1990 | Amra et al. | 415/121.2 |

FOREIGN PATENT DOCUMENTS

| | | | |
|---|---|---|---|
| 661851 | 4/1963 | Canada | 415/200 |

*Primary Examiner*—John T. Kwon

*Attorney, Agent, or Firm*—Larry W. Evans; Joseph G. Curatolo; Scott A. McCollister

[57] ABSTRACT

A molten metal pump includes an impeller disposed at the end of an elongate drive shaft. The drive shaft is disposed within an elongate, hollow post. The impeller and the end of the post are adapted to be immersed in molten metal. An inert gas is conveyed through the gap between the outer surface of the drive shaft and the inner surface of the post, which gas is discharged into the molten metal in the vicinity of the impeller. Because the drive shaft is insulated from the molten metal, it can be made of a durable material such as steel; because the post is stationary relative to the molten metal, the metal is stirred only by the impeller, and not by the drive shaft. The invention includes other features such as a quick disconnect capability and a radial adjustment capability.

23 Claims, 5 Drawing Sheets

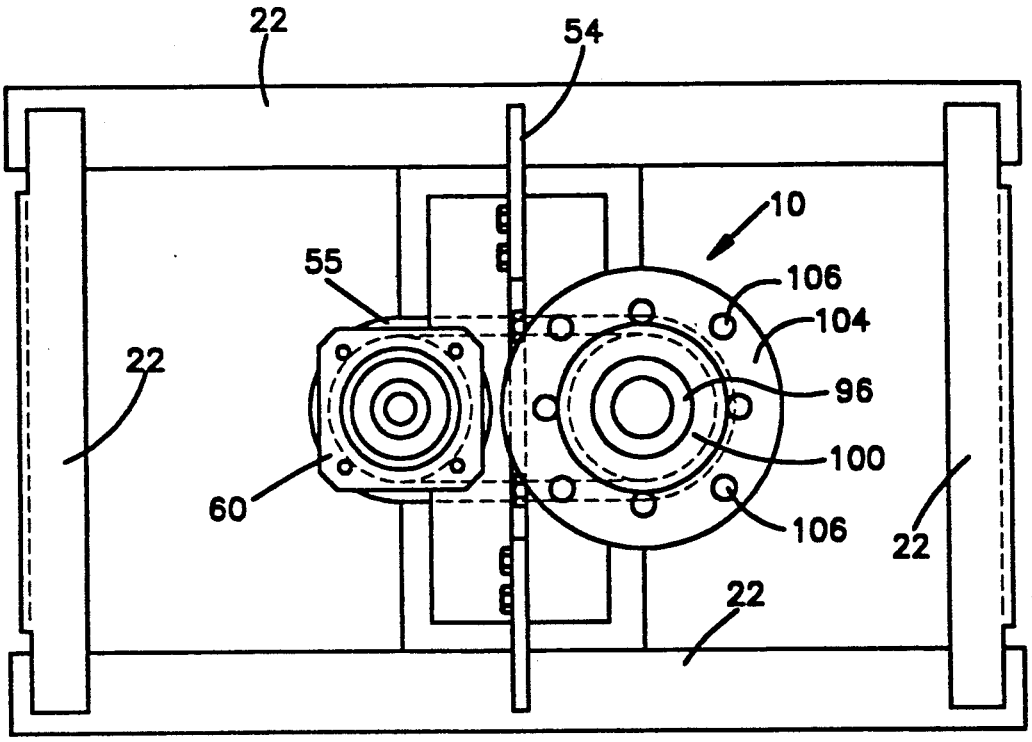
Fig.4
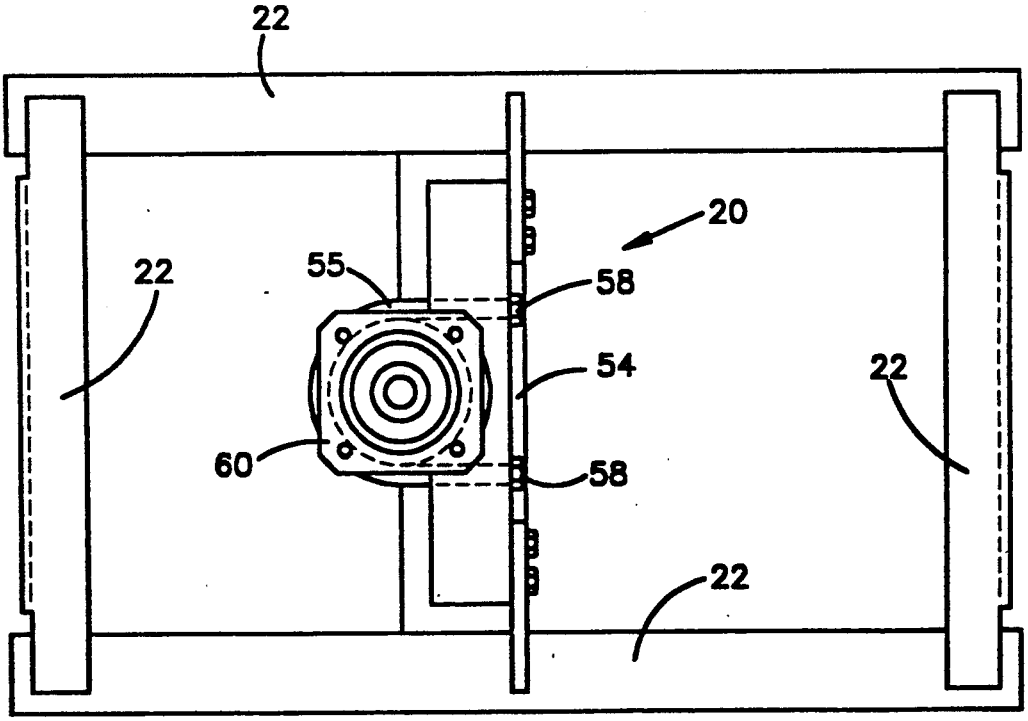
Fig.5
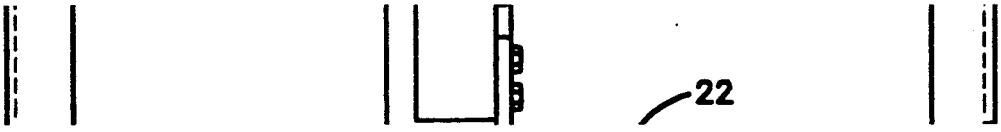

MOLTEN METAL PUMP

This application is a continuation of application Ser. No. 07/315,619, filed Feb. 24, 1989, now abandoned.

FIELD OF THE INVENTION

The invention relates to molten metal pumps and, more particularly, to a compact pump having a drive shaft of indefinite life.

BACKGROUND OF THE INVENTION

In the processing of molten metals, it often is necessary to pump the molten metal from one place to another. When it is desired to remove molten metal from a vessel, a so-called transfer pump is used. When it is desired to circulate molten metal within a vessel, a so-called circulation pump is used. When it is desired to purify molten metal disposed within a vessel, a so-called gas injection pump is used. In each of these pumps, a rotatable impeller is disposed within the molten metal and, upon rotation of the impeller, the molten metal is pumped as desired. Molten metal pumps of the type referred to are commercially available from Metaullics Systems, 31935 Aurora Road, Solon, Ohio 44139 under the model designation M28-C et al.

In each of the pumps referred to, the impeller is disposed within a cavity formed in a base member. The base member is suspended within the molten metal by means of refractory posts. The impeller is supported for rotation in the base member by means of a rotatable refractory shaft. The base member includes an outlet passageway in fluid communication with the impeller. Upon rotation of the impeller, molten metal is drawn into the impeller, where it then is discharged under pressure through the outlet passageway.

Although the pumps in question operate satisfactorily to pump molten metal from one place to another, certain problems have not been addressed. One of these problems relates to the durability of the drive shaft. Typically the drive shaft is made of a material such as graphite. Graphite is a preferred material for molten metal applications because of its relative inertness to corrosion and also because of its thermal shock resistance. Graphite can be protected from high temperature oxidation and erosion by various sleeves, coatings, and treatments, but it nevertheless deteriorates with time. Another problem with graphite is that it is not very strong, and a graphite drive shaft can be fractured if it is handled roughly or if a large torque load is imposed on the shaft. Desirably, a technique would be found that would increase the longevity of the drive shaft.

Another problem that is not addressed by the pumps in question is that of stirring the molten metal by means of the drive shaft. That is, because the drive shaft rotates in the molten metal, the drive shaft itself stirs the molten metal, causing surface dross formation (metal oxide) which sticks to the shaft and which ultimately can cause imbalance and dynamic failure. Desirably, the molten metal pump would move the molten metal only under the influence of the impeller.

The pumps in question fail to address various other concerns. For example, the pumps are relatively large and heavy, in part because the base member is large, and because the base member must be supported by means of a number of stationary refractory posts. Due to the configuration of the pump, it is difficult or impossible to change the discharge point of the pump relative to the vessel within which the pump is disposed. In the transfer pump embodiment, the outlet portion of the pump sometimes will be broken if the users of the pump do not take proper precautions to avoid undue loading of the outlet. Yet an additional problem relates to difficulties associated in removing the drive shaft and impeller from the pump when replacement of the shaft or the impeller is necessary.

SUMMARY OF THE INVENTION

The present invention provides a new and improved molten metal pump that overcomes the foregoing difficulties. In its most basic form, the invention includes an elongate, hollow refractory post having first and second ends, the first end adapted to extend out of the molten metal and the second end adapted to extend into the molten metal. An elongate drive shaft is disposed within the post for rotation therein, the drive shaft having a first end adapted to extend out of the first end of the post, and a second end adapted to be disposed adjacent the second end of the post.

An impeller is connected to the second end of the drive shaft, the outer surface of the drive shaft and the inner surface of the post being spaced relative to each other such that inert gas can be conveyed therebetween for discharge into the molten metal in the vicinity of the impeller. By virtue of the foregoing construction, the drive shaft is shielded from the molten metal by the refractory post, and it is cooled by the inert gas. Accordingly, the drive shaft can be made of a material such as steel having an indefinite life. Moreover, because the post does not rotate relative to the molten metal, the molten metal is pumped only under the influence of the impeller.

In the preferred embodiment, a stator is connected to the second end of the post. The stator includes a cavity within which the impeller is disposed, an inlet into which molten metal can be drawn, and an outlet through which molten metal can be discharged, the impeller being spaced from the stator a distance such that gas can be conveyed therebetween. The stator preferably also includes an outlet through which gas can be discharged into the molten metal. It has been found that the gap between the impeller and the stator is important to proper functioning of the device, which gap should be approximately 0.015 inches.

The invention includes a variety of other advantageous features. These features include an adjusting mechanism for the stator that permits the output of the pump to be directed in any desired radial direction. A quick-disconnect coupling is provided for the first end of the drive shaft so that the drive shaft can be quickly connected to, and disconnected from, a drive motor. Spaced collars are secured to the first end of the drive shaft to permit (a) an adjustment of the gap between the impeller and the stator and (b) a maximum axial displacement of the drive shaft relative to the post upon initial disassembly of the pump.

A transfer pump embodiment of the invention includes a riser tube that is configured identically to the post. A hollow extension projects from the upper end of the riser tube for connection to a stationary support member. A flange is disposed about the hollow extension to permit a user's plumbing to be connected to the hollow extension in any desired radial position.

The molten metal pump according to the invention is exceedingly compact and lightweight compared with prior art pumps. It has an extremely effective pumping action, a drive shaft of essentially indefinite life, and adjustment capabilities that are exceedingly flexible and easy to use. The foregoing and other features and advantages of the invention are illustrated in the accompanying drawings and are described in more detail in the specification and claims that follow.

BRIEF DESCRIPTION OF THE DRAWINGS

FIG. 4 is a top plan view of the pump of FIG. 2;

FIG. 5 is a top plan view of the pump of FIG. 3;

DESCRIPTION OF THE PREFERRED EMBODIMENT

Figure 1:
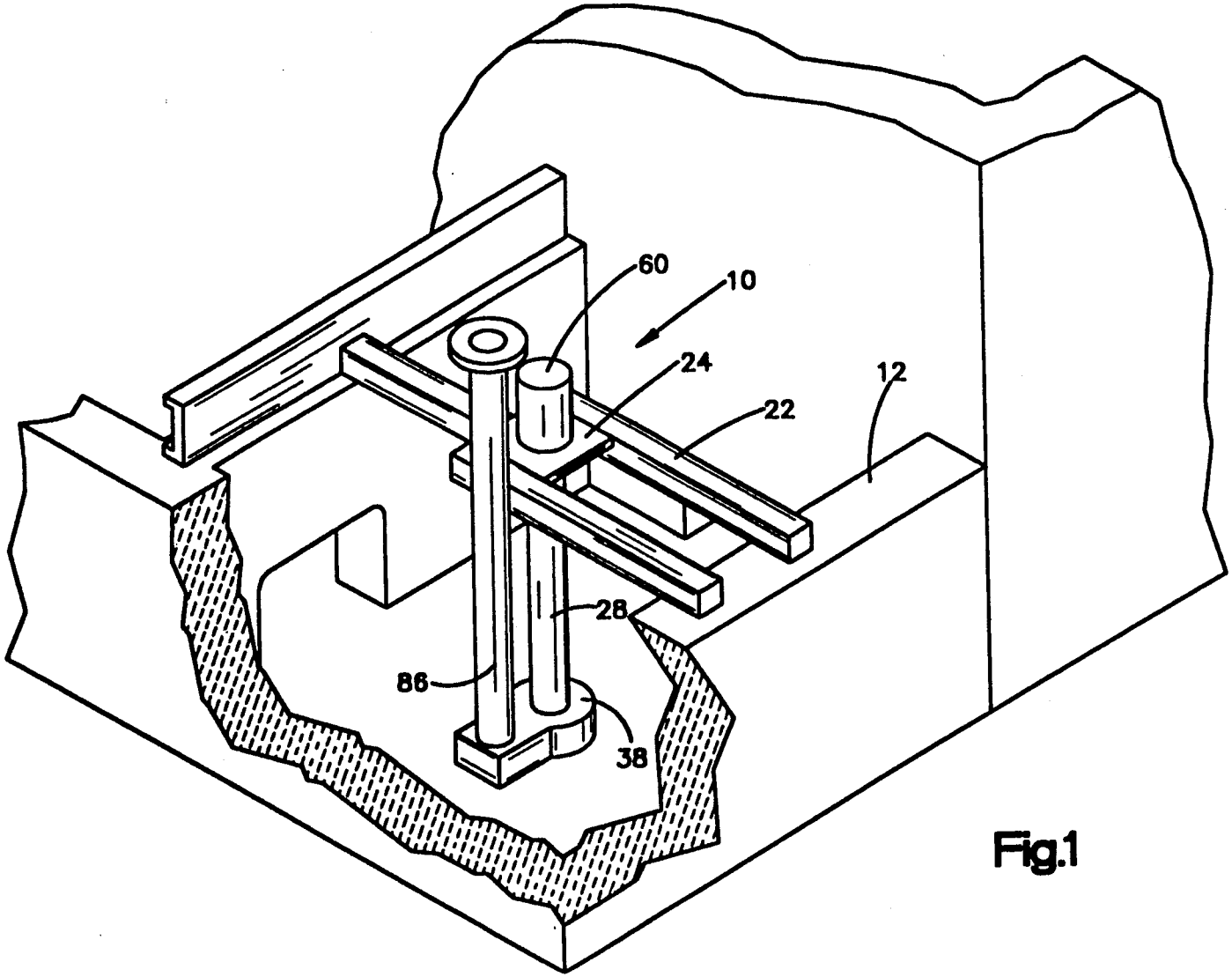
FIG. 1 is a schematic, perspective view of a molten metal pump according to the invention as it might be used in practice.
Figure 2:
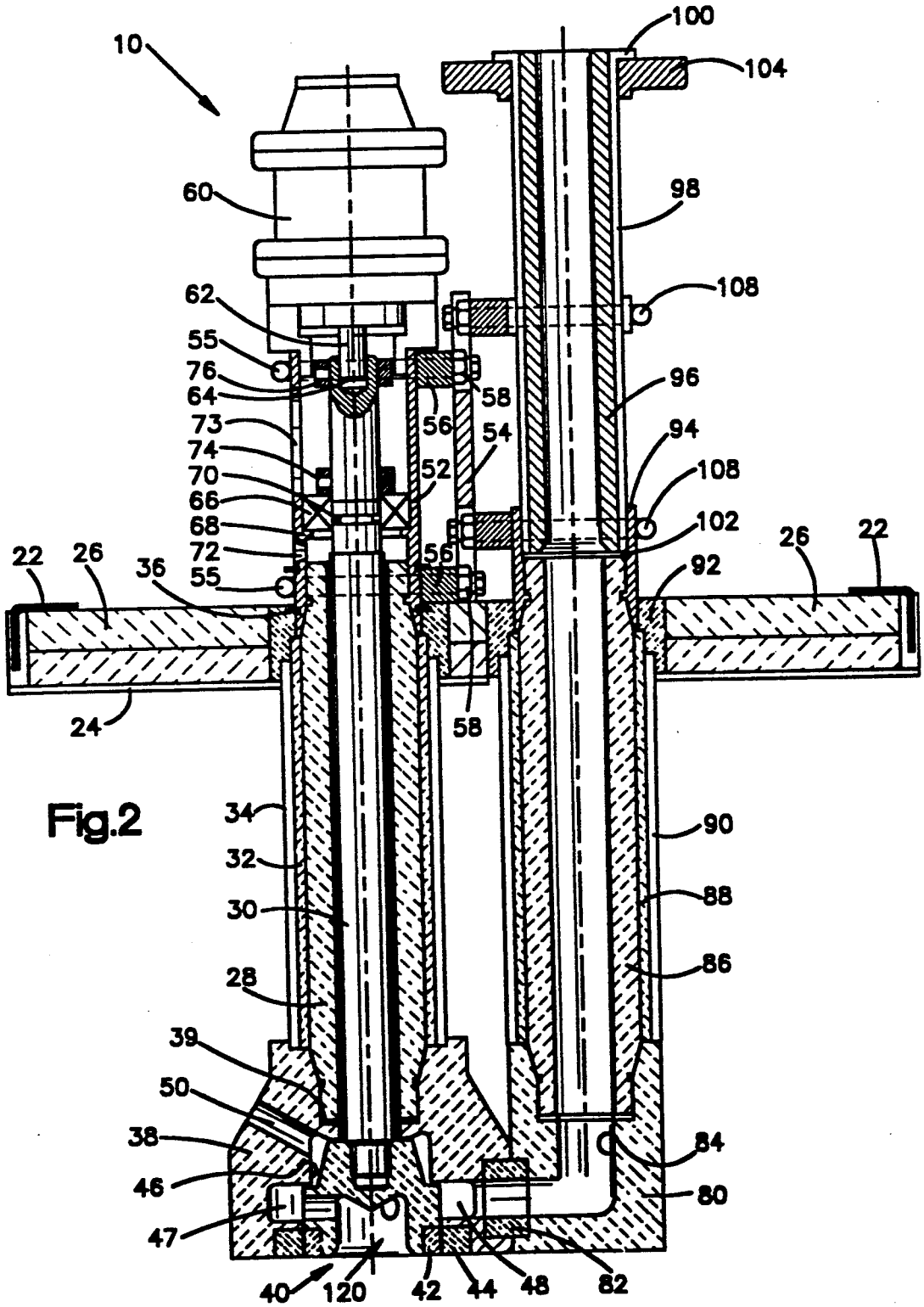
FIG. 2 is a cross-sectional view of the pump of FIG. 1.

Referring to FIGS. 1, 2 and 4, a molten metal pump according to the invention is indicated generally by the reference numeral 10. The pump 10 is adapted to be immersed in molten metal contained within a vessel 12. The vessel 12 can be any container containing molten metal; in the embodiment illustrated, the vessel 12 is the external well of a reverberatory furnace.

Figure 3:
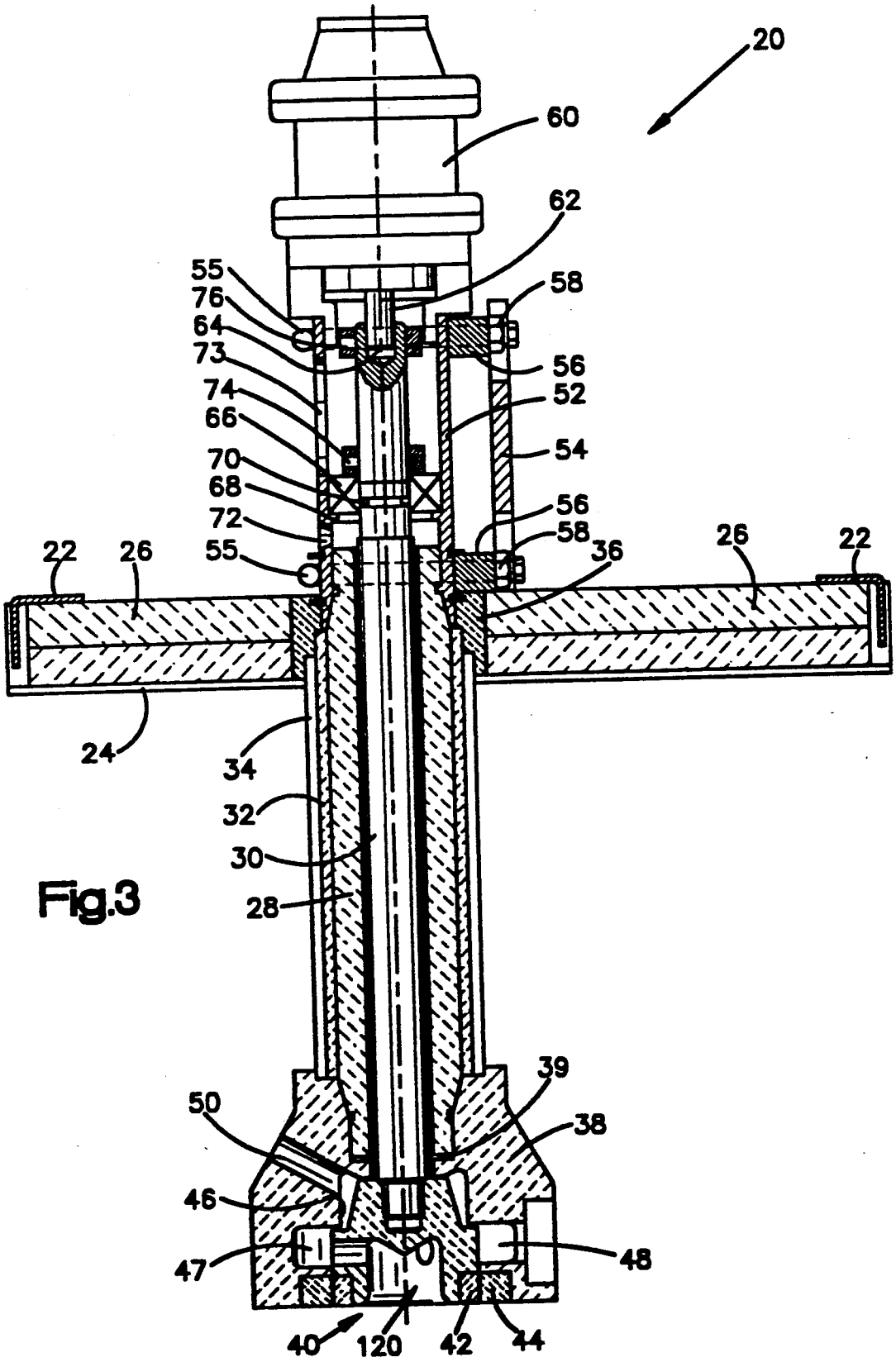
FIG. 3 is a cross-sectional view of an alternative embodiment of the pump of FIG. 1.
Figure 7:
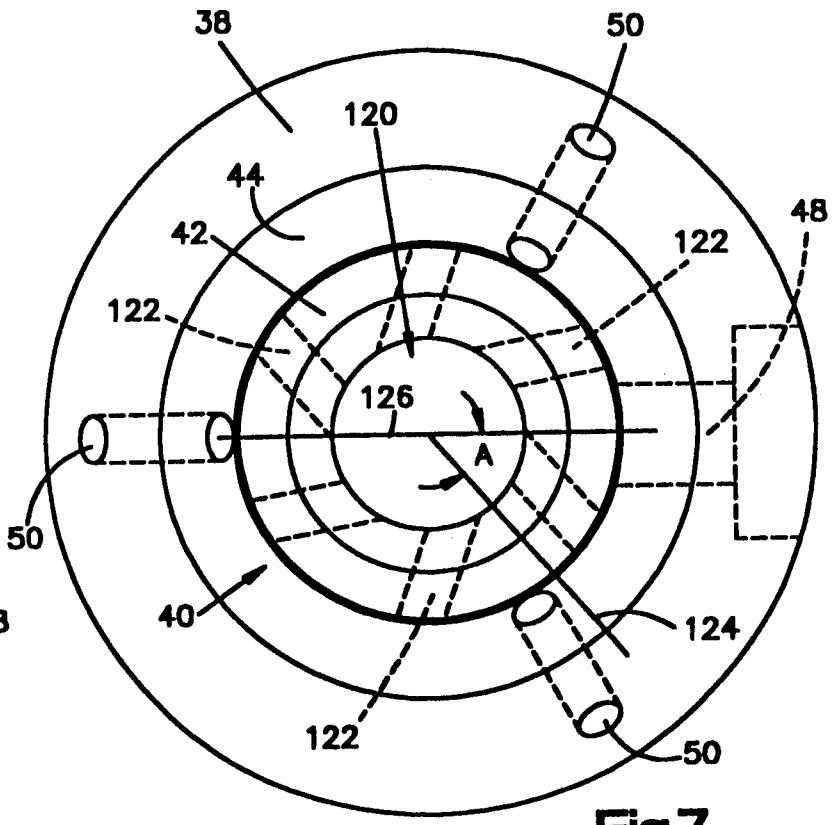
FIG. 7 is a bottom plan view of the pump of FIG. 3.

Referring to FIGS. 3 and 5, an alternative embodiment of the invention is indicated by the reference numeral 20. The embodiments 10 and 20 share many common features, and like reference numerals will be used where appropriate. The principal difference between the two embodiments is that the pump 10 is a so-called transfer pump, that is, it transfers metal from the vessel 12 to another location, whereas the pump 20 is a so-called circulation pump, that is, it circulates metal within the vessel 12.

Referring to the various Figures, the pumps 10 and 20 are supported by means of elongate angle irons 22 between which a support plate 24 is suspended. Insulation batts 26 are disposed atop the plate 24. The pumps 10, 20 include a vertically oriented, elongate, hollow refractory post 28 within which a drive shaft 30 is supported for rotation. The post 28 typically is made of graphite, and is protected by means of a layer of intumescent paper 32 and a refractory coating 34 of silicon carbide or similar material. The upper, or first end of the post 28 is surrounded by an insulation collar 36. The second, or lower end of the post 28 carries a base member, or stator 38. The stator 38 is secured to the post 28 by means of an internal threaded connection. A cement fillet is disposed at the interface between the refractory coating 34 and the upper end of the stator 38. The end face of the second end of the post 28 is disposed adjacent a flat, counterbored surface within the stator 38. A facing gasket 39 of intumescent paper is disposed in the gap between the end of the post 28 and the flat, counterbored surface.

An impeller 40 is threadedly secured to the end of the drive shaft 30. A first bearing ring 42 of silicon carbide or other material having bearing properties at high temperature is disposed about the lowermost end of the impeller 40. A second bearing ring 44 of silicon carbide or other material having bearing properties at high temperature is disposed at the lowermost end of the stator 38 in facing relationship to the first bearing ring 42.

As will be apparent from the foregoing description, the impeller 40 is rotatable relative to the stator 38. The bearing rings 42, 44 will prevent friction-related wear of the stator 38 and the impeller 40 from occurring. The stator 38 includes a cavity 46 within which the impeller 40 is disposed and a pumping chamber 47 that surrounds the impeller 40. The stator 38 includes an outlet 48 through which molten metal can be pumped under pressure, the outlet 48 being in fluid communication with the chamber 47. The stator 38 also includes three passageways 50 for the discharge of gas, as will be described subsequently.

The post 28 and the shaft 30 are spaced a small distance from each other so that inert gas can be pumped therebetween. At the lower end of the post 28, at that point where the upper surface of the impeller 40 comes closest to contacting the uppermost surface of the cavity 46, a small gap is maintained. Although the gap changes on heating of the parts, it desirably is maintained at approximately 0.015 inch. The passageways 50 are in communication with the impeller-stator gap and serve to bleed gas from the cavity 46 into the vessel 12.

A cylindrical extension 52 projects from the upper end of the post 28 and is connected thereto by means of an internal threaded connection. The upper, or first end of the drive shaft 30 projects from the first end of the post 28 into the volume defined by the extension 52. A vertically extending plate, or support member 54 is connected to the angle irons 22. A pair of U-bolts 55 are passed about the extension 52 and are secured to the support member 54 by means of spacers 56 and nuts 58. A drive motor 60 is secured to the upper end of the extension 52. In the embodiment illustrated, the motor 60 is an air motor, although it can be any type that may be desired. With particular reference to pump 20, if the U-bolts 55 are loosened, the pump 20 can be rotated about the longitudinal axis of the drive shaft 30. In turn, the outlet 48 can be oriented in any desired direction. Upon tightening the U-bolts 55, the pump 20 will be locked in the selected radial position.

The motor 60 includes a splined drive shaft 62. The upper end of the drive shaft 30 includes a cavity 64 having longitudinal grooves formed in its inner surface that mate with the splines of the drive shaft 62, thereby providing a driving connection between the motor 60 and the drive shaft 30. The upper end of the shaft 30 is supported for rotation by means of a bearing 66. The bearing 66 is supported atop a radially inwardly directed flange 68. An O-ring 70 is carried by the upper end of the shaft 30 in order to create a fluid-tight seal between the shaft 30 and the bearing 66. The fluid-tight seal thus created separates the lower portion of the pumps 10, 20 from the upper portion of the pumps 10, 20. Because of the seal, the lower portion can be pressurized without pressurizing the upper portion.

An opening 72 is formed in the side of the extension 52 at a vertical location below the flange 68. The opening 72 permits compressed gas to be directed into the gap between the post 28 and the drive shaft 30. Another opening 73 is formed in the side of the extension 52 at a vertical location above the flange 68. The opening 73 permits the user to have access to the upper interior portion of the extension 52 and the pump components disposed therein.

A first collar 74 is disposed about the drive shaft 30 on the side of the bearing 66 opposite the impeller 40. The first collar 74 is adjustably connected to the drive shaft 30 such that the axial position of the drive shaft 30 relative to the post 28 can be adjusted. Because the impeller 40 is rigidly secured to the end of the shaft 30, the adjustment of the shaft 30 thus described permits the gap between the stator 38 and the impeller 40 to be adjusted.

A second collar 76 is disposed about the drive shaft 30 on the side of the first collar 74 opposite the impeller 40. The second collar 76 is rigidly secured to the drive shaft 30. Whenever it is desired to remove the drive shaft 30 and the impeller 40 from the pump, the first collar 4 can be loosened in order to permit the drive shaft 30 to be moved to a lowered position. The second collar 76 will prevent the drive shaft 30 from falling out of the pump. After the impeller 40 has been removed, the drive shaft 30 can be retracted upwardly through the extension 52.

With particular reference to FIG. 2, the pump 10 includes an elbow 80 that is connected to the base member 38 by means of an internal sleeve 82. The elbow 80 includes a passageway 84 that is in fluid communication with the outlet passageway 48. A riser tube 86 is connected to the upper end of the elbow 80. The riser tube 86 is protected by a layer of intumescent paper 88 and a refractory coating 90. The upper end of the riser tube 86 is surrounded by an insulating collar 92. It is expected that the riser tube 86, intumescent paper 88, and refractory coating 90 will be substantially identical to the post 28, intumescent paper 32, and refractory coating 34.

A short, hollow, cylindrical extension 94 projects from the upper end of the riser tube 86 and is connected thereto by means of an internal threaded connection. A second hollow extension 96 projects upwardly from the first extension 94. A sleeve 98 having a radially extending flange 100 at its upper end is fitted about the extension 96. The lower end of the sleeve 98 extends into the upper end of the extension 94. A paper gasket 102 is compressed between the upper end of the riser tube 86 and the lower end of the extension 96 and the sleeve 98.

A flange 104 is loosely disposed about the sleeve 98. The flange 104 includes openings 106 (FIG. 4) that enable the extension 96 to be connected to a spout (not shown) or other type of conduit by means of bolts (not shown) that compress the spout against the exposed upper surface of the flange 100. Because the flange 104 is rotatable about the longitudinal axis of the extension 96, the spout or other conduit can be radially positioned as may be desired.

The extension 94, and the sleeve 98 are connected to the support member 54 by means of U-bolts 108, spacers 110, and nuts 112. This construction is substantially identical to that previously described for support of the extension 52.

Referring particularly to FIGS. 2, 3, 6 and 7 the impeller 40 is a generally cup-like structure defining a cavity 120 that is exposed along the lower surface of the pump. A plurality of laterally extending cylindrical openings 122 extend through the side wall of the impeller 40. The openings 122 provide fluid communication between the cavity 120 and the chamber 47. In the embodiment illustrated, six openings 122 are provided. The openings are equidistantly spaced from each other about the periphery of the impeller 40. The centerlines of the openings 122 do not project radially from the center of the impeller 40, but rather are parallel to a first line 124 extending radially from the center of the impeller 40, the first line being located at an angle A from a second line 126 bisecting the impeller 40. In the embodiment illustrated, the angle A is 60° and the centerlines of the openings 122 are spaced approximately 0.375 inch from the line 124.

The passageways 50 are positioned equidistantly about the stator 38. The centerlines of the passageways 50 are inclined approximately 30° from the horizontal.

Figure 6:
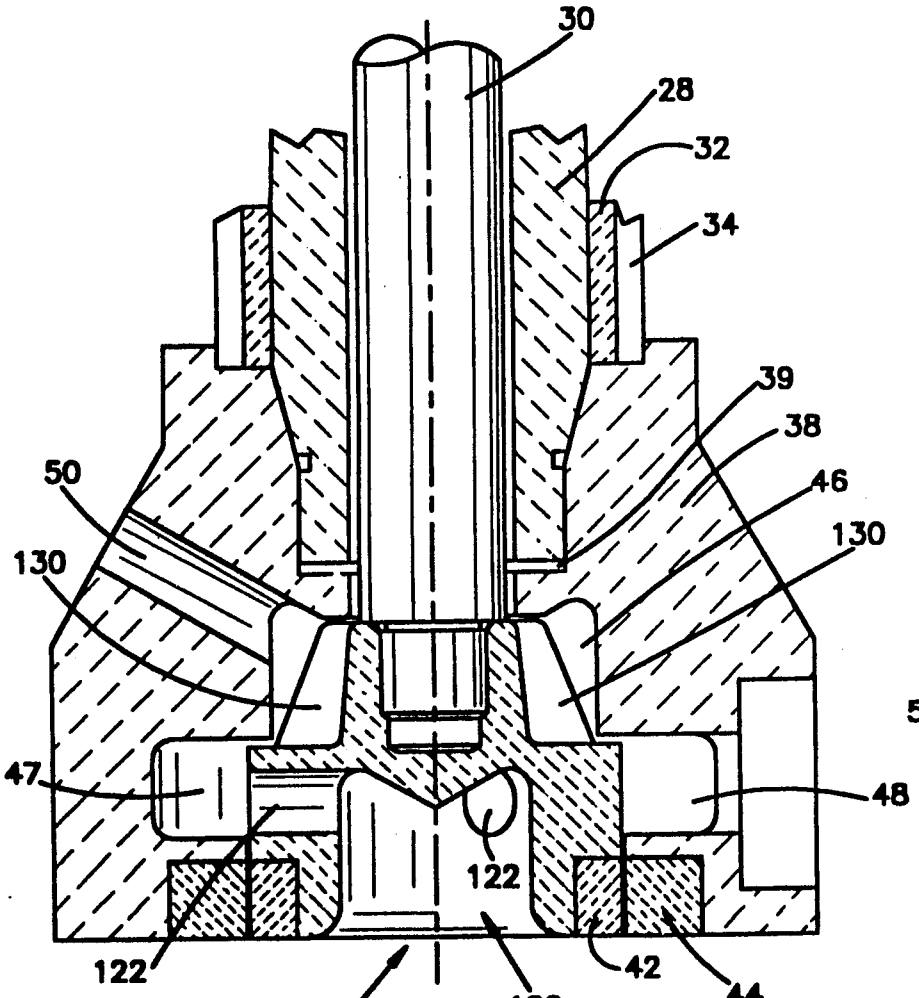
FIG. 6 is an enlarged cross-sectional view of a portion of the pump of FIG. 3 showing a modified form of impeller.

Referring to FIG. 6, a modified form of the impeller 40 is shown. The impeller 40 is identical to the impeller 40 shown in FIGS. 2 and 3 except that the impeller 40 shown in FIG. 6 includes, near its upper end, a plurality of radially extending vanes 130. The vanes 130 are disposed within the cavity 46. It is expected that the impeller 40 having vanes 130 will be used if it is desired to inject purifying gases into the molten metal being pumped by the impeller 40. The vanes 130 will act as shearing vanes that will break up bubbles of gas being discharged into the molten metal into very fine bubbles that will be intimately mixed with the molten metal immediately upon their discharge from the passageways 50. If intimate mixing of the gas with the molten metal is not of concern, then the shearing vanes 130 can be eliminated.

It will be appreciated from the foregoing description that the molten metal pump according to the invention is exceedingly compact and lightweight. Because the drive shaft 30 is encased within the stationary post 28, and because inert gas is pumped between the post 28 and the drive shaft 30, the drive shaft 30 is well protected from the molten metal in which the pump is immersed. In turn, the drive shaft 30 can be made of metal such as steel, thereby having an essentially indefinite life. Moreover, because the post 28 is stationary, the molten metal is pumped only by the action of the impeller 40.

The invention has a number of other advantages that will be apparent from the foregoing description. These advantages include the use of a drive shaft that cannot be fractured upon the application of high torsion loads as sometimes occurs during the operation of molten metal pumps. In the transfer pump embodiment, the connection between the user's plumbing and the extension 96 is such that there is no stress load applied to the riser tube 86 or the extension 96. Accordingly, potential damage to the riser tube 86 or the extension 96 due to rough handling by the user is minimized or eliminated.

Additional advantages of the invention include the capability of rotating the outlet passageway 48 of the pump 20 in any desired direction. In the transfer pump embodiment, the use of the same element for the post 28 and the riser tube 86 minimizes expense. The particular manner in which the drive shaft 30 is supported within the post 28, and the technique by which the drive shaft 30 is prevented from falling out of the post 28 upon disassembly, provides advantages of efficiency of operation and ease of assembly and disassembly.

Although the invention has been described in its preferred form with a certain degree of particularity, it will be understood that the present disclosure of the preferred embodiment has been made only by way of example and that various changes may be resorted to without departing from the true spirit and scope of the invention as hereinafter claimed. It is intended that the patent shall cover, by suitable expression in the appended claims, whatever features of patentably novelty exist in the invention disclosed.

What is claimed is:

1. A molten metal pump, comprising:

an elongate, hollow, refractory post having first and second ends, the first end adapted to extend out of the molten metal and the second end adapted to extend into the molten metal;

an elongate drive shaft disposed within the post for rotation therein, the drive shaft having first and second ends, the first end adapted to extend out of the first end of the post and the second and adapted to be disposed adjacent the second end of the post;

an impeller connected to the second end of the drive shaft;

a stator connected to the second end of the post, the stator including a cavity within which the impeller is disposed, an inlet into which molten metal can be drawn, an outlet through which molten metal can be discharged, and an opening through which gas can be discharged into the molten metal, the impeller being spaced from the stator; and means for conveying gas between the outer surface of the drive shaft and the inner surface of the post, through the space between the impeller and the stator, and through the opening in the stator.

2. The molten metal pump of claim 1, wherein the smallest gap between the impeller and the stator is approximately 0.015 inch.

3. The molten metal pump of claim 1, further comprising a bearing member lining a portion of the cavity in the stator, and a bearing member surrounding a portion of the impeller, the bearing members being disposed adjacent each other for sliding contact during use.

4. The molten metal pump of claim 3, wherein the bearing members are made of a refractory material such as silicon carbide.

5. The molten metal pump of claim 1, further comprising a support member to which the first end of the post is secured, the post being radially adjustable relative to the support member.

6. The molten metal pump of claim 5, further comprising a cylindrical extension projecting from the first end of the post, and a U-bolt passing about the cylindrical extension, the U-bolt being releasable connected to the support member.

7. The molten metal pump of claim 5, further comprising a hollow extension projecting from the first end of the post, a drive motor connected to the hollow extension, and a releasable connection between the drive motor and the first end of the drive shaft.

8. The molten metal pump of claim 6, wherein the drive motor is connected to the drive shaft by means of a splined connection.

9. The molten metal pump of claim 1, further comprising a hollow extension projecting from the first end of the post, a bearing disposed within the extension, the bearing being axially fixed relative to the extension, the bearing having an opening through which the first end of the drive shaft projects, the bearing supporting the first end of the drive shaft for rotation.

10. The molten metal pump of claim 9, further comprising a first collar disposed about the drive shaft on the side of the bearing opposite the impeller, the first collar being adjustably connected to the drive shaft such that the axial position of the drive shaft relative to the post can be adjusted.

11. The molten metal pump of claim 10, further comprising a second collar disposed about the drive shaft on the side of the first collar opposite the impeller, the second collar being rigidly secured to the drive shaft such that removal of the drive shaft from the post can be prevented upon loosening the first collar.

12. The molten metal pump of claim 9, further comprising an opening in the side of the hollow extension, the opening being in fluid communication with the space between the drive shaft and the post.

13. The molten metal pump of claim 1, further comprising a hollow fitting connected to the outlet of the stator, and a riser tube connected to the fitting, the riser tube having a first end disposed outside the molten metal and a second end connected to the outlet of the fitting.

14. The molten metal pump of claim 13, wherein the riser tube is of the same size and shape as the post.

15. The molten metal pump of claim 13, further comprising a hollow extension projecting from the first end of the riser tube, and a support member to which the hollow extension is connected.

16. The molten metal pump of claim 15, further comprising a U-bolt passing about the hollow extension, the U-bolt being releasably connected to the support.

17. The molten metal pump of claim 15, further comprising a flange loosely disposed about the hollow extension, the flange being radially adjustable relative to the hollow extension.

18. The molten metal pump of claim 1, further comprising insulation disposed about the outer surface of the post.

19. The molten metal pump of claim 18, wherein the insulation is in the form of intumescent paper in contact with the post and a refractory coating disposed about the intumescent paper.

20. The molten metal pump of claim 1, wherein the drive shaft is made of steel.

21. A method of protecting a drive shaft used in a molten metal pump, comprising the steps of:

providing an elongate, hollow, refractory post having first and second ends;

providing an elongate drive shaft having first and second ends;

providing an impeller and attaching the impeller to the second end of the drive shaft;

providing a stator and connecting the stator to the second end of the post, the stator including a cavity, an inlet into which molten metal can be drawn, an outlet through which molten metal can be discharged, and an opening through which gas can be discharged into the molten metal;

placing the drive shaft within the refractory post such that the first end of the drive shaft is adjacent the first end of the post and the impeller is adjacent the second end of the post, the impeller being disposed within the cavity and spaced from the stator;

placing the second end of the post and the impeller in molten metal while keeping the first end of the post and the first end of the drive shaft out of the molten metal;

rotating the drive shaft while preventing the post from rotating; and conveying gas between the post and the drive shaft, through the space between the impeller and the stator, and through the opening in the stator for discharge into the molten metal.

22. The method of claim 21, wherein the smallest gap between the impeller and the stator is approximately 0.015 inch.

23. The method of claim 21, wherein the drive shaft is made of steel.

* * * * *